US005707140A

United States Patent [19]

Chen

[11] Patent Number: 5,707,140

[45] Date of Patent: Jan. 13, 1998

[54] STRUCTURE OF LAMP SHADE FOR HALOGEN LAMPS

[76] Inventor: Wen-Tsung Chen, 8F-6, No. 100, Sec.2, Hoping E. Road, Taipei, Taiwan

[21] Appl. No.: 412,004

[22] Filed: Mar. 28, 1995

[51] Int. Cl.[6] ..... F21V 17/06

[52] U.S. Cl. ..... 362/294; 362/378

[58] Field of Search ..... 362/294, 378, 362/350, 429, 410, 362, 263

[56] References Cited

U.S. PATENT DOCUMENTS

| | | | |
|---|---|---|---|
| 4,635,172 | 1/1987 | Steinke | 362/294 |
| 5,032,966 | 7/1991 | Maurer | 362/429 |
| 5,428,517 | 6/1995 | Behringer | 362/294 |

*Primary Examiner*—Ira S. Lazarus
*Assistant Examiner*—Sara Sachie Raab
*Attorney, Agent, or Firm*—Beveridge, DeGrandi, Weilacher & Young LLP

[57] ABSTRACT

A lamp shade includes a shade body having a circular mounting hole, a mounting socket fastened to the circular mounting hole by a lock ring to hold a halogen lamp, and a heat insulation shield fastened to the mounting socket and covered around the halogen lamp, wherein: the mounting socket comprises an annular head stopped outside the shade body, a socket body longitudinally extended from the annular head and inserted into the circular mounting hole, two symmetrical mounting notches on the annular head for mounting the halogen lamp, an outer thread around the socket body, a first screw hole on the annular head into which a tightening up screw is threaded to hold down the halogen lamp, and a second screw hole on the socket body into which a tie screw is threaded to hold the heat insulation shield in place; the lock ring has an inner thread threaded onto the outer thread on the socket body of the mounting socket; the heat insulation shield is sleeved onto the socket body of the mounting socket, having a screw hole fastened to the second screw hole by the tie screw.

1 Claim, 8 Drawing Sheets

STRUCTURE OF LAMP SHADE FOR HALOGEN LAMPS

BACKGROUND OF THE INVENTION

The present invention relates to lamp shapes, and more particularly to a lamp shade for use with a halogen lamp.

FIGS. 1 and 1A show a lamp shade for halogen lamps according to the prior art which comprises a shade body having a circular mounting hole; a mounting socket fastened to the circular mounting hole of the shade body on the inside to hold the lamp socket of a halogen lamp, the mounting socket having a screw hole at one end into which a tightening up screw is threaded and engaged into an annular groove around the lamp socket of the halogen lamp to fix the mounting socket to the lamp socket of the halogen lamp; a barrel made of an open tube having a front end connected to the mounting socket inside the shade body; a heat insulation shield connected to the rear end of the barrel by a tightening up screw and covered around the lamp bulb on the lamp socket of the halogen lamp. This structure of lamp shade still has drawbacks. One drawback of this structure of lamp shade is that the heat insulation shield tends to be damaged by the tightening up screw when an excessive driving pressure is acted onto the tightening up screw. Another drawback of this structure of lamp shade is that the barrel tends to disconnect from the mounting socket, more particularly after a long use of the lamp shade.

SUMMARY OF THE INVENTION

The present invention has been accomplished under the aforesaid circumstances. According to one aspect of the present invention, the lamp shade comprises a shade body having a circular mounting hole, a mounting socket fastened to the circular mounting hole by a lock ring to hold a halogen lamp, and a heat insulation shield fastened to the mounting socket and covered around the halogen lamp, wherein: the mounting socket comprises an annular head stopped outside the shade body, and a socket body longitudinally extended from the annular head and inserted into the circular mounting hole and having an outer thread; the lock ring has an inner thread threaded onto the outer thread on the socket body of the mounting socket to hold down the mounting socket in place.

According to another aspect of the present invention, the socket body of the mounting socket has a first screw hole on the annular head through which a tightening up screw is threaded to hold down the halogen lamp in the mounting socket, and a second screw hole on the socket body; the heat insulation shield is sleeved onto the socket body of the mounting socket, having a screw hole fastened to the second screw hole on the socket body of the mounting socket by a tie screw.

DETAILED DESCRIPTION OF THE PREFERRED EMBODIMENTS

Figure 1:
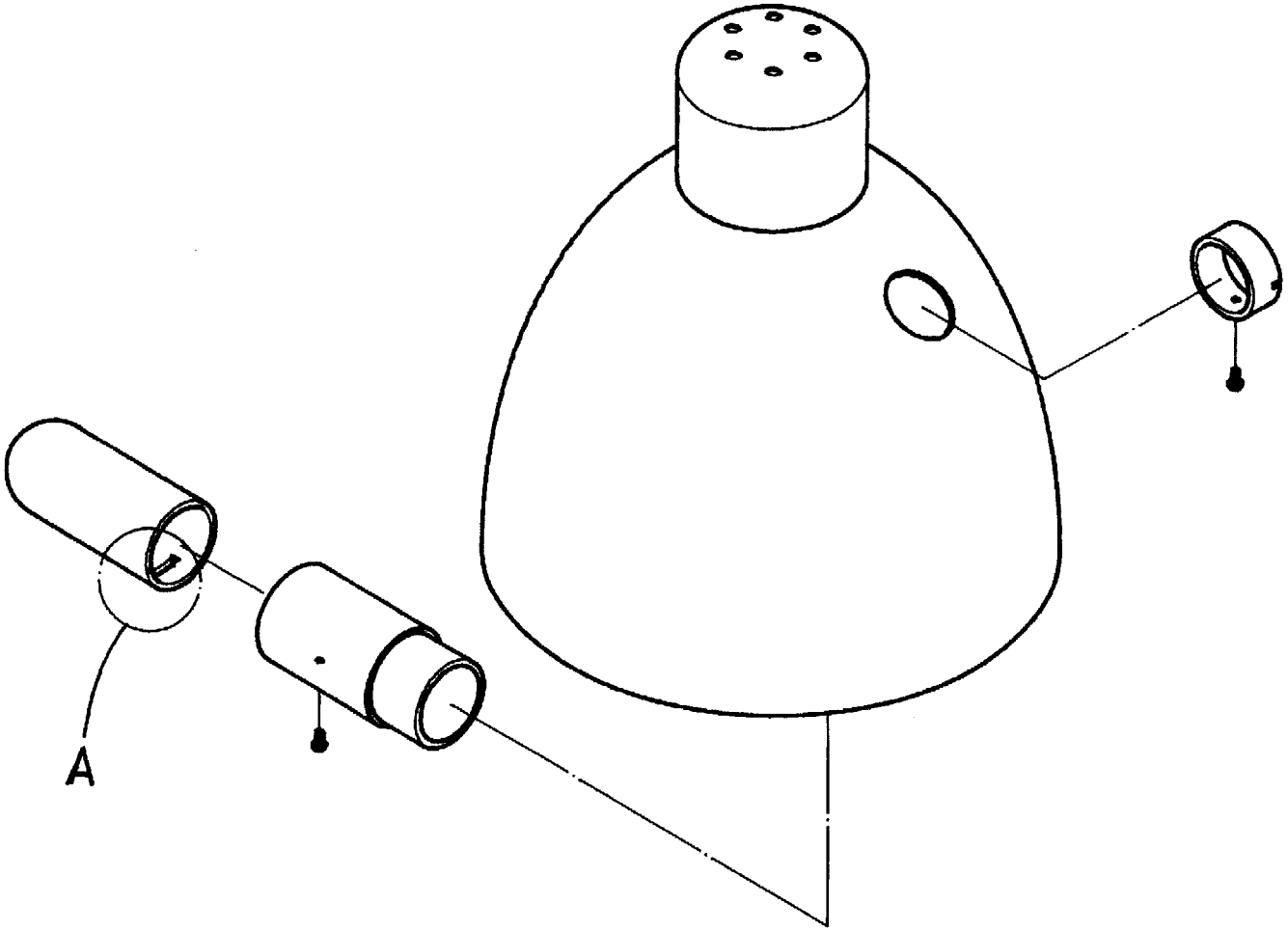
FIG. 1 is an exploded view of a lamp shade according to the prior art.
Figure 1A:
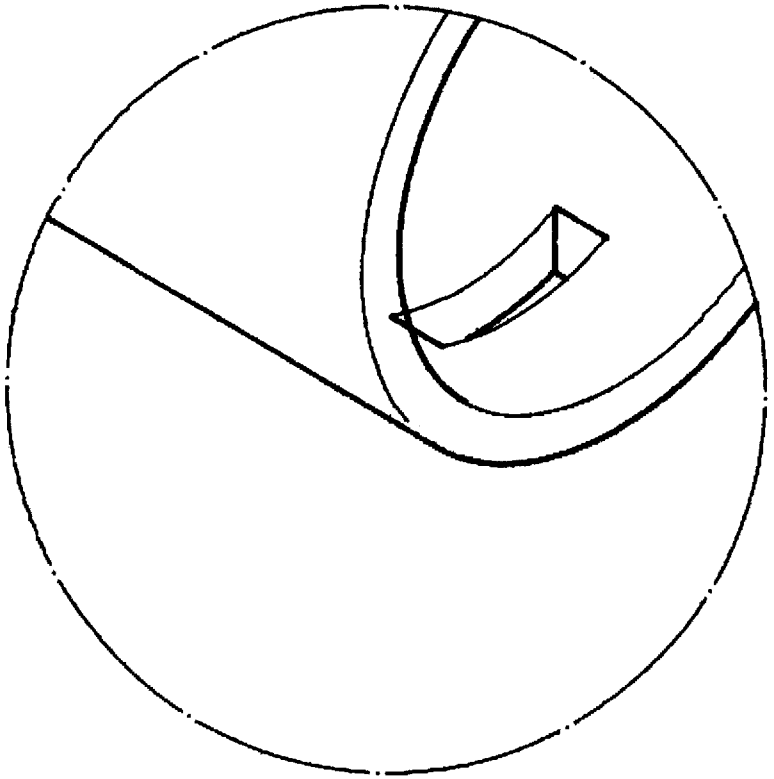
FIG. 1A is an enlarged view taken on part A of FIG. 1.
Figure 2:
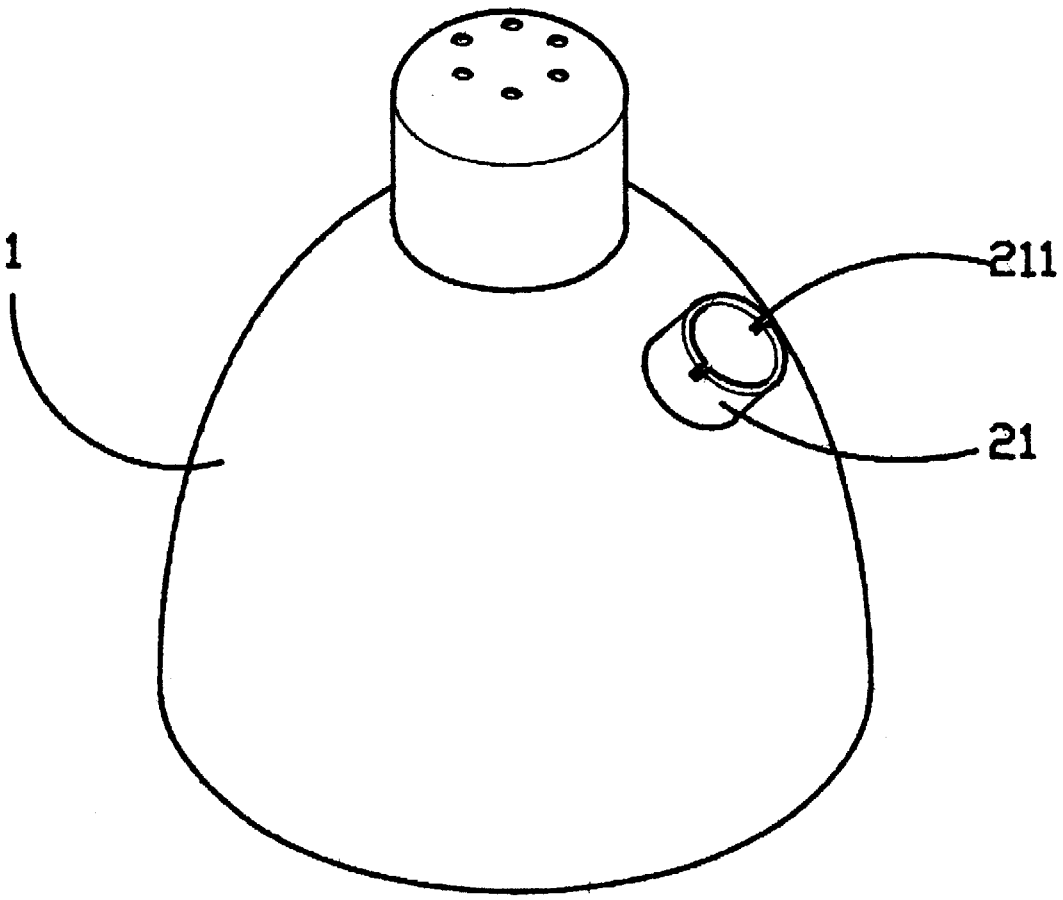
FIG. 2 is an elevational view of a lamp shade according to the present invention.
Figure 3:
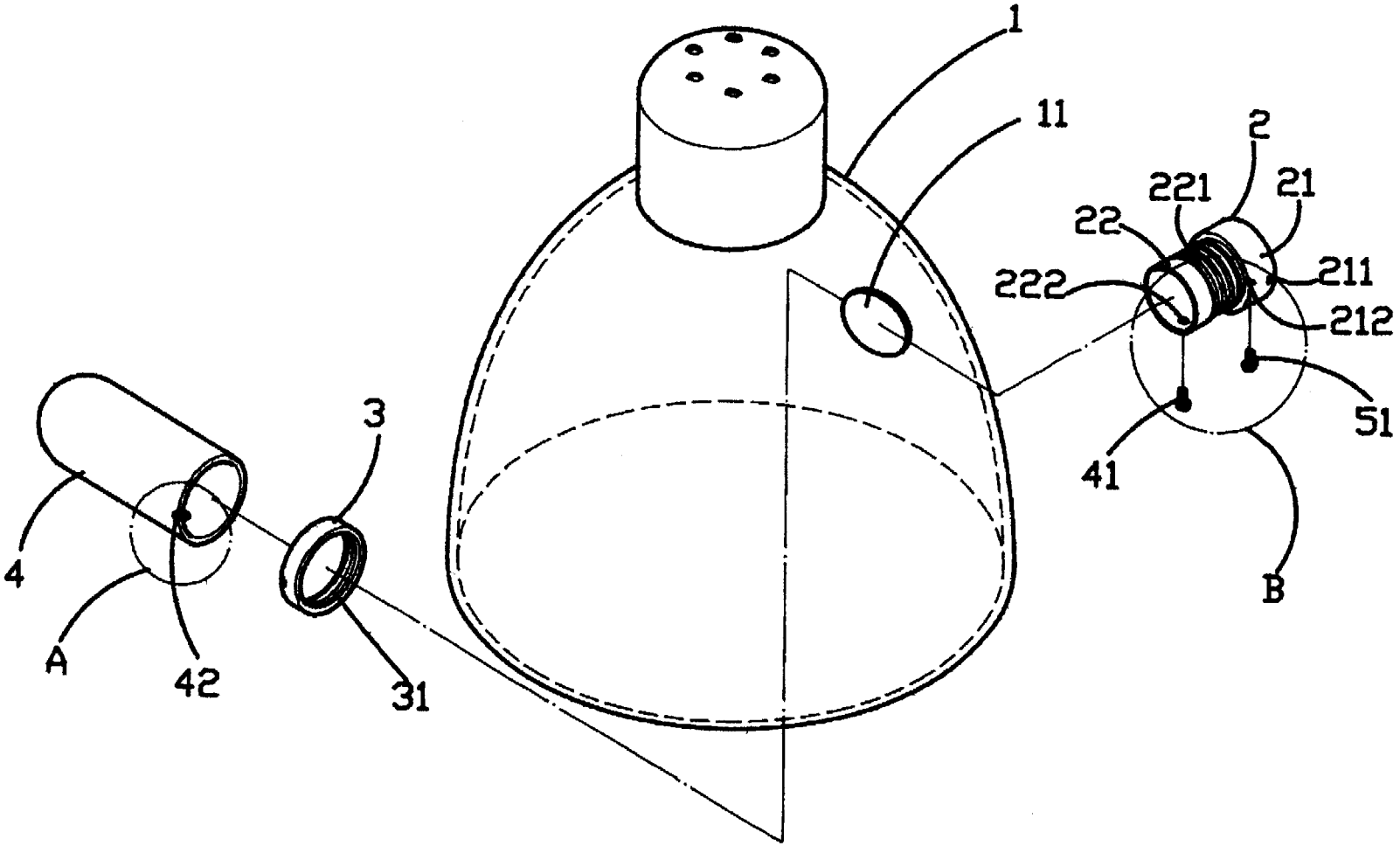
FIG. 3 is an exploded view of the lamp shade shown in FIG. 2.
Figure 3A:
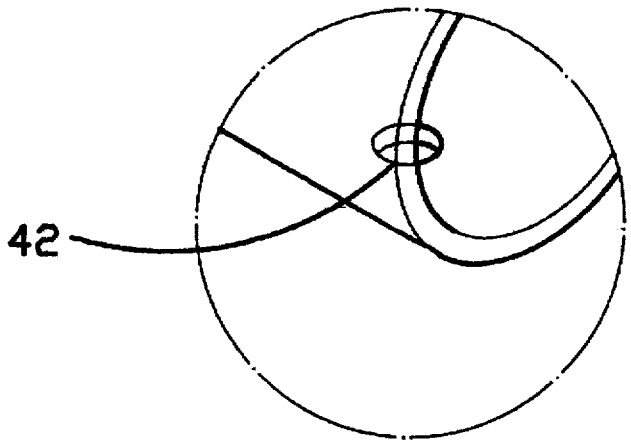
FIG. 3A is an enlarged view taken on part A of FIG. 3.
Figure 3B:
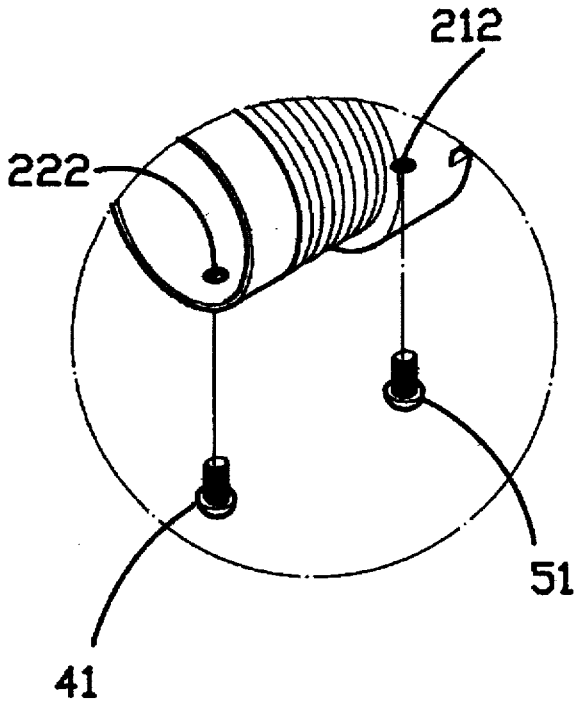
FIG. 3B is an enlarged view taken on part B of FIG. 3.
Figure 4:
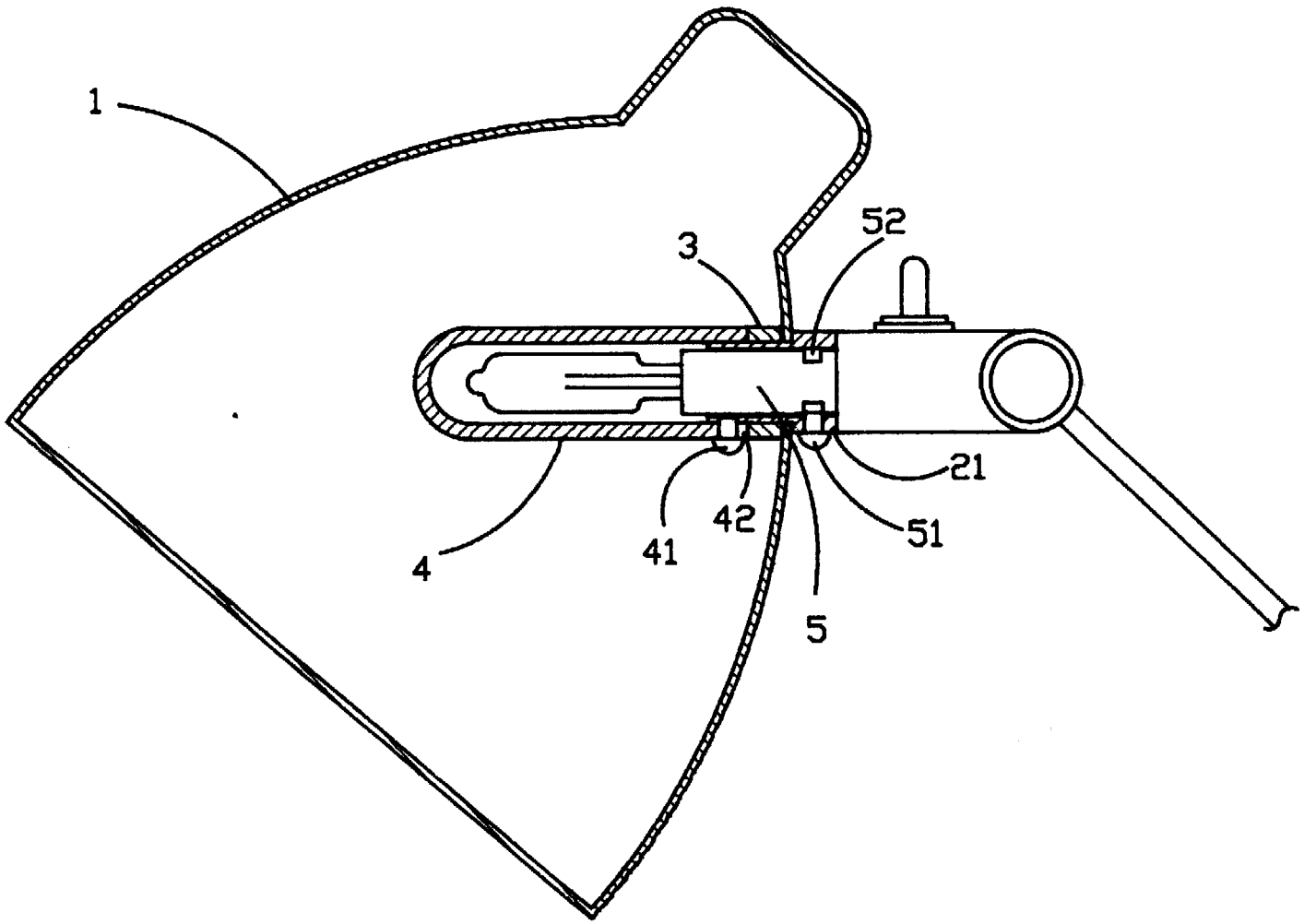
FIG. 4 is a plain view in section showing the lamp shade of FIG. 2 installed.

Referring to FIGS. 2, 3, 3A, 3B, and 4, a lamp shade in accordance with the present invention is generally comprised of a shade body 1, a headed mounting socket 2, a lock ring 3, and a heat insulation shield 4. The shade body 1 may be made of any of a variety of shapes (see FIGS. 5 and 6), having a circular mounting hole 11 for mounting the mounting socket 2. The headed mounting socket 2 is fastened to the circular mounting hole 11 of the shade body 1 by the lock ring 3 to hold the heat insulation shield 4. The headed mounting socket 2 comprises an annular head 21 stopped outside the shade body 1, a socket body 22 longitudinally extended from the annular head 21 and inserted into the circular mounting hole 11 on the shade body 1, two symmetrical mounting notches 211 on the annular head 21, an outer thread 221 around the socket body 22, a first screw hole 212 on the head 21, and a second screw hole 222 on the socket body 22. The lock ring 3 has an inner thread 31 threaded onto the outer thread 221 on the socket body 22 of the headed mounting socket 2. The heat insulation shield 4 is sleeved onto the socket body 22 of the headed mounting socket 2, having a screw hole 42 connected to the second screw hole 222 on the socket body 22 of the headed mounting socket 2 by a screw 41.

Referring to FIG. 4 again, when a halogen lamp holder 5 is inserted into the headed mounting socket 2 to hold a halogen lamp bulb in the heat insulation shield 4, a tightening up screw 51 is threaded into the first screw hole 212 on the head 21 of the headed mounting socket 2 into an annular groove 52 around the periphery of the halogen lamp holder 5 to hold down the halogen lamp 5 in position. Because the halogen lamp holder 5 is fastened to the headed mounting socket 2 by the tightening up screw 51, the halogen lamp holder 5 can be turned relative to the headed mounting socket 2 when the tightening up screw 51 is loosened.

Figure 5:
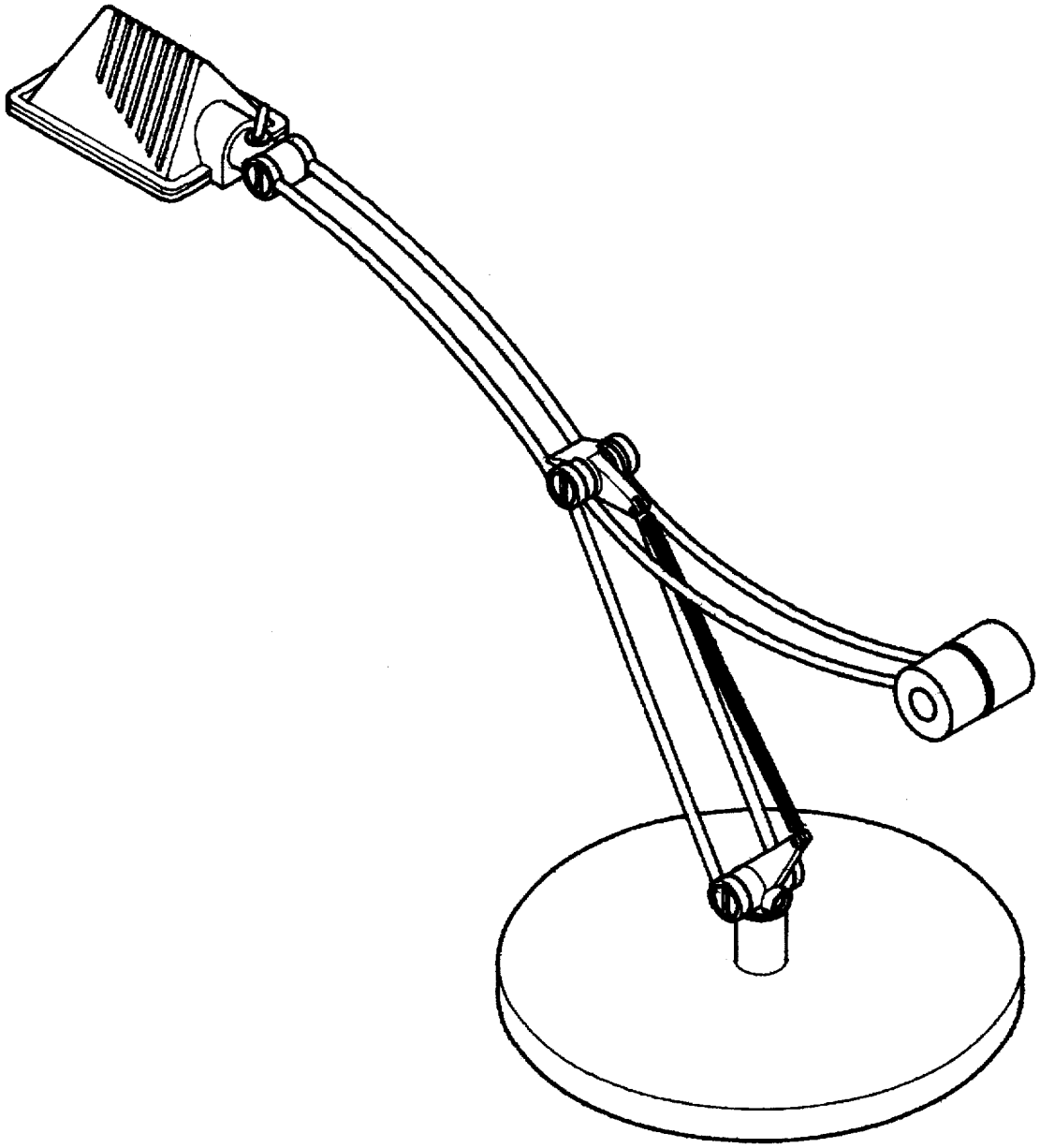
FIG. 5 is an elevational view of a desk lamp made according to the present invention.
Figure 6:
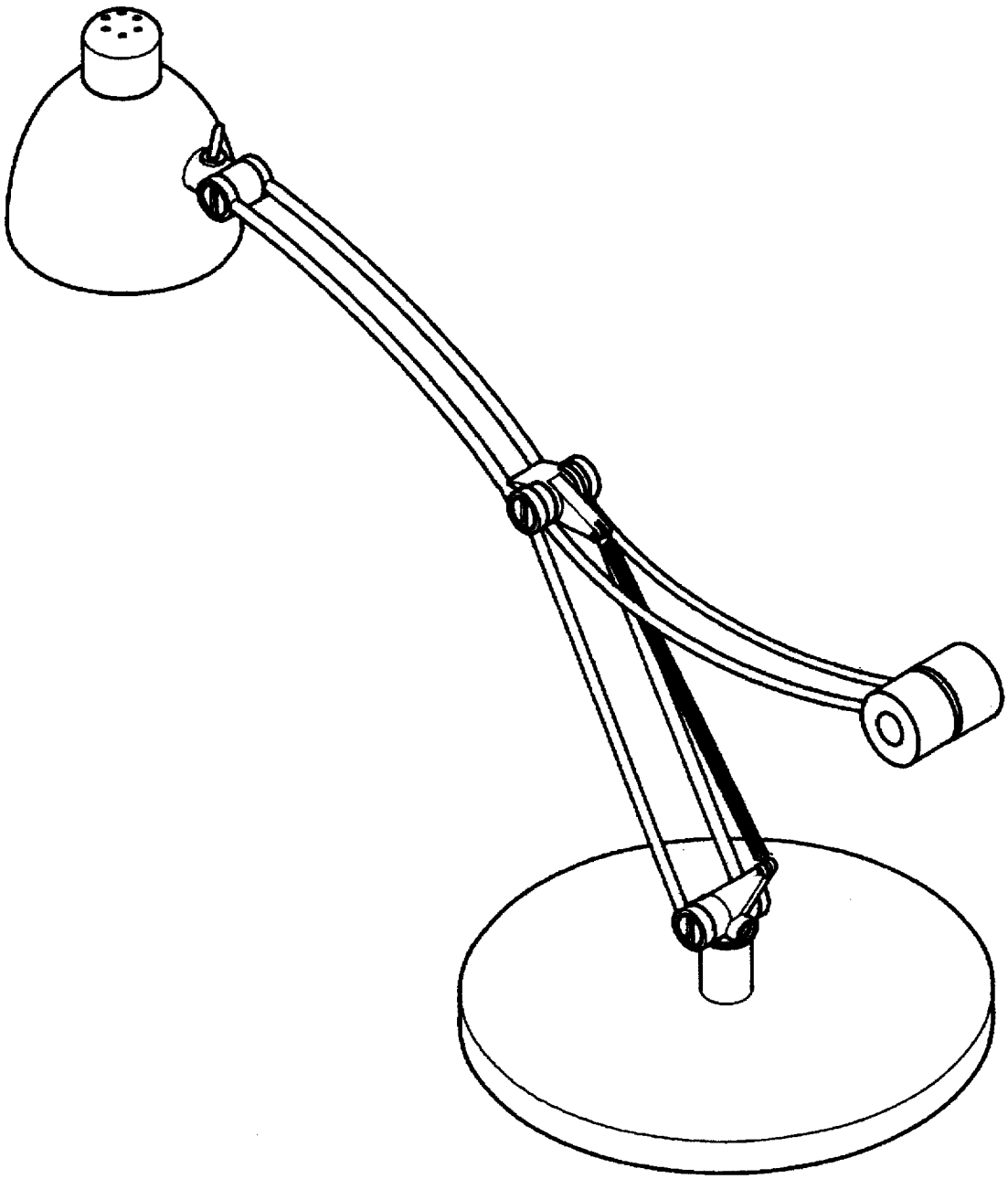
FIG. 6 is an elevational view of another structure of desk lamp made according to the present invention.

FIGS. 5 and 6 show two different application examples of the present invention. As illustrated, the shade body 1 can be made of any of a variety of shapes.

It is to be understood that the drawings are designed for purposes of illustration only, and are not intended as a definition of the limits and scope of the invention disclosed.

What is claimed is:

1. A halogen lamp shade comprising a shade body defining a circular mounting hole on its surface, a mounting socket mounted on said shade, said socket comprising an annular head and a hollow socket body extending from said annular head into said circular mounting hole, said annular head disposed on the outer surface of said shade body, said socket body having a threaded portion, said annular head having a first screw opening therein, said hollow socket body having a second screw opening therein, a locking ring threadingly engaging said socket body to hold said mounting socket onto said lamp shade, a halogen lamp holder disposed within said socket body and said annular head, said lamp holder having an annular groove on that portion of its surface extending into said annular head, a screw passing through said first screw opening in said annular head and into said annular groove to fasten said lamp holder to said mounting socket, a hollow heat insulation shield in contact with one end of said socket body, said heat insulation shield having a screw opening therein aligned with said second screw opening on said socket body, and a screw extending through said aligned openings to fasten said heat insulation shield to said socket body.

* * * * *